US009192234B2

(12) United States Patent
Grove

(10) Patent No.: US 9,192,234 B2
(45) Date of Patent: Nov. 24, 2015

(54) PROGRESSIVELY CURVED LUMBAR SUPPORT FOR THE BACK OF A CHAIR

(71) Applicant: James E. Grove, Marina Del Rey, CA (US)

(72) Inventor: James E. Grove, Marina Del Rey, CA (US)

( * ) Notice: Subject to any disclaimer, the term of this patent is extended or adjusted under 35 U.S.C. 154(b) by 0 days.

(21) Appl. No.: 14/166,410

(22) Filed: Jan. 28, 2014

(65) Prior Publication Data

US 2015/0208809 A1 Jul. 30, 2015

(51) Int. Cl.
*A47C 7/46* (2006.01)
*A47C 1/033* (2006.01)
*A47C 7/44* (2006.01)

(52) U.S. Cl.
CPC ..... *A47C 1/033* (2013.01); *A47C 7/445* (2013.01); *A47C 7/462* (2013.01)

(58) Field of Classification Search
CPC ..... A47C 7/46; A47C 7/462
USPC ..... 297/61, 284.4, 284.7, 284.8
See application file for complete search history.

(56) References Cited

U.S. PATENT DOCUMENTS 3,762,769 A * 10/1973 Poschl ..... 297/284.4
3,929,374 A * 12/1975 Hogan et al. ..... 297/61
5,104,189 A * 4/1992 Hanai et al. ..... 297/284.4
5,558,399 A * 9/1996 Serber ..... 297/284.4
6,059,362 A * 5/2000 Lin ..... 297/284.5
6,517,156 B1 * 2/2003 Lin ..... 297/284.4
6,805,405 B2 * 10/2004 Koo ..... 297/284.7
7,086,700 B2 * 8/2006 Habedank ..... 297/378.1
7,226,127 B1 * 6/2007 Yevko et al. ..... 297/284.1
7,695,067 B2 * 4/2010 Goetz et al. ..... 297/284.8
7,874,618 B2 * 1/2011 Kohl et al. ..... 297/284.4
2005/0275263 A1 * 12/2005 Norman et al. ..... 297/284.4

* cited by examiner

*Primary Examiner* — Peter Brown

(74) *Attorney, Agent, or Firm* — Law Offices of Morland C. Fischer

(57) ABSTRACT

A progressively curved lumbar support located within the back of an office or home chair to enable a user to be seated close to a work surface (e.g., a desk or a table). The chair back tilts backwards and forwards when the user shifts his weight back and forth. The lumbar support includes a cushion back support manufactured from a resilient material that is responsive to a compressive force applied thereto when the user reclines against the chair back. In particular, a tilt pressure-responsive rod rides up and down over a pair of inclined guide blocks to cause the cushion back support to change its shape from a convex configuration at which to support the user's lower back and maintain a proper posture when the user sits erect and the chair back stands upright to a relatively flattened configuration when the chair back tilts backwards.

15 Claims, 5 Drawing Sheets

PROGRESSIVELY CURVED LUMBAR SUPPORT FOR THE BACK OF A CHAIR

BACKGROUND OF THE INVENTION

1. Field of the Invention

This invention relates to a lumbar support located inside the back of a chair of the kind which rocks back and forth, such as that commonly found in an office or home so that a user can be seated close to a work surface (e.g., a desk or a table). The lumbar support is adapted to progressively change its shape from an arced, convex configuration to a substantially flat configuration in response to a pressure applied to the chair back so as to provide support and maintain a proper posture of the user's back when the chair back stands upright and the user's back is erect and close to the work surface and when the chair back rocks backwards and the user reclines away from the work surface.

2. Background Art

A wide variety of chairs have been used in an office or at home to enable a user to be seated adjacent a work surface. In this case, the user can access a computer, a book, a writing pad, etc. which lays upon the work surface so that the user can work while seated. Some chairs are adapted to rock back and forth in response to the user shifting his weight backwards and forwards. With the chair rocked forwards, the user's back is located close to the work surface during which work can be accomplished. When the chair rocks backwards, the user's back is correspondingly reclined and tilted away from the work surface to enable the user to relax.

A common problem with such conventional office and home chairs occurs when the chair rocks forward and the user tries to hold his back erect and close to the work surface. In particular, even when the back of the chair stands upright, the back of the user is usually spaced forwardly from the chair back. Therefore, the chair back offers little or no support for the user's lower back throughout those times when the user is working. Consequently, the user's back posture may suffer and, especially during long periods of work, the user may experience lower back pain and discomfort. What is even more, when the chair rocks back, the back of the chair typically retains its initial shape and is therefore unable to adjust for an increased compressive force generated by the user leaning against the chair back.

What would be desirable is a chair which overcomes these problems to enable the user's back to be adequately supported by the chair back so that a proper posture is maintained and comfort is enhanced when the chair rocks forward and back. Reference may be made to my pending patent application Ser. No. 14/051,251 filed Oct. 10, 2013 for an example of a dynamic lumbar support located in the back of a chair to improve posture and comfort.

SUMMARY OF THE INVENTION

In general terms, a progressively curved lumbar support is disclosed to be located inside the back of a chair that has particular application for use in an office or a home so that a user can be seated adjacent a work surface (e.g., a desk or a table) with his back erect. The chair is of the kind that rocks back and forth when the user shifts his weight backwards and forwards. The progressively curved lumbar support herein disclosed is responsive to a pressure applied by the user against the chair back. That is, the lumbar support is adapted to continuously change its shape from an arced, convex configuration to a substantially flat configuration as the user shifts his weight against the chair back. By virtue of the foregoing, the user's lower back will be supported and a proper posture maintained when the chair rocks forward and the back of the chair stands upright and when the chair rocks back and the chair back tilts away from the work surface.

The progressively curved lumbar support within the back of the chair includes a rigid (e.g., plywood) backing and a resilient (e.g., foam) cushion back support that is located in front of and spaced from the backing. The cushion back support has an initially arced, protruding configuration. A flexible posture-maintaining sheet is positioned against the cushion back support to urge the protruding back support towards the lower back of the user. A pair of inclined guide blocks having ramped surfaces are attached to the backing. A tension strap runs vertically through the chair back within the space between the backing and the cushion back support. One end of the tension strap is connected to a tilt pressure-responsive rod which runs horizontally across the chair back for receipt by the pair of inclined guide blocks.

As the user leans back and the chair rocks backwards, a compressive force is applied by the user's back against the cushion back support, whereby the flexible posture-maintaining sheet is flexed. At the same time, the tension strap bends back and the horizontally extending tilt pressure-responsive rod connected thereto is simultaneously pushed along the cushion back support and down the ramped surfaces of the pair of inclined guide blocks. The movement of the tilt pressure-responsive rod over the inclined guide blocks in response to the pressure generated by the user's back controls the curvature of the cushion back support. More particularly, the initially arced, convex cushion back support will be progressively and continuously flattened as the tilt pressure-responsive rod rides down the guide blocks and along the back support. When the compressive force is terminated and the chair rocks forwards, the tension strap recovers, and the tilt pressure-responsive rod is correspondingly pulled up the ramped surfaces of the inclined guide blocks. Accordingly, the previously flattened cushion back support returns to its initial arced, convex configuration to once again protrude towards and support the lower back of the user.

The respective tops of the rigid backing and the cushion back support of the progressively curved lumbar support inside the chair back are pivotally connected to one another by means of hinges. By virtue of the foregoing, the back support is rotatable relative to the backing during manufacture of the chair from a folded closed position lying opposite the backing to an unfolded open position standing upwardly from the backing. The hinges also permit the cushion back support to pivot and shift relative to the backing when the tilt pressure-responsive rod is being pushed and pulled over the pair of inclined guide blocks.

DESCRIPTION OF THE PREFERRED EMBODIMENT

Figure 1:
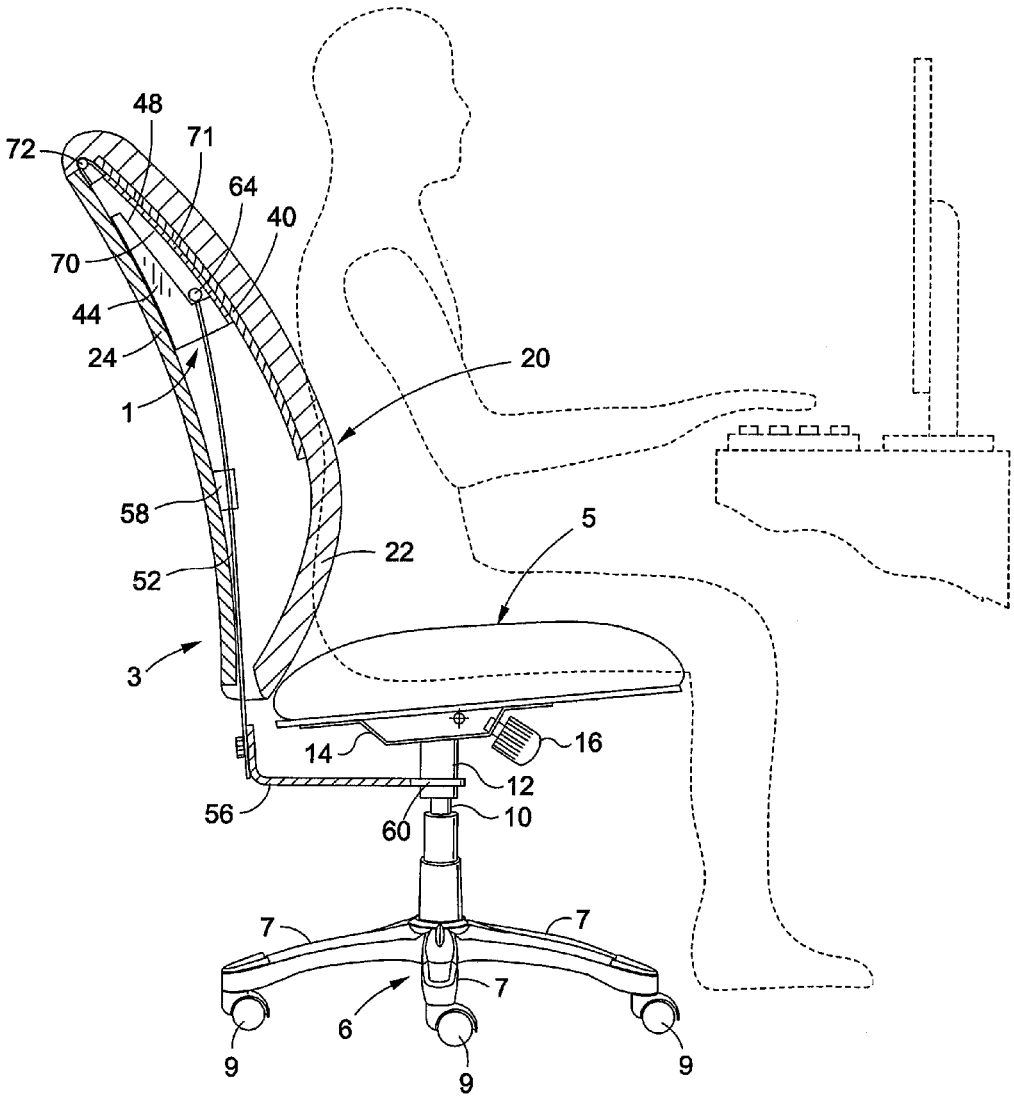
FIG. 1 is a side view of a chair having a progressively curved lumbar support according to a preferred embodiment located inside the chair back and including a cushion back support having an initial arced, convex shape when a user leans forward and sits erect in the chair adjacent a work surface.

Referring concurrently to FIGS. 1-5 of the drawings, a progressively curved lumbar support 1 is shown and disclosed for use at the back of a chair 3. The chair 3 is preferably one that rocks back and forth and is of the kind that would commonly be found in an office or at home to provide a seat for one working at a desk, a table or a similar work surface. However, the specific use of the chair 3 is not to be regarded as a limitation of this invention.

Like a typical chair, the chair 3 shown in FIGS. 1-5 includes a seat 5 to support the weight of a user. The chair seat 5 is held above the ground by a base 6 having a set of outstretched legs 7 to which respective rollers 9 are attached to permit the chair 3 to be moved from place-to-place. A gas cylinder 10 extends between the base 6 and a gas cylinder receiver 12 that projects downwardly from a seat plate 14. A lever arm (designated 15 in FIGS. 3 and 4) cooperates with the gas cylinder 10 to enable the elevation of the seat 5 to be adjusted to suit the needs of the user. A tension adjustment knob 16 is accessible below the seat plate 14. The tension adjustment knob 16 is rotated to adjust the spring tension of the seat 5 depending upon the size and weight of the user.

The progressively curved lumbar support 1 is located within the back 20 of the chair 3. As will soon be explained, and as an important advantage of this invention, the lumbar support 1 initially has an arced, convex configuration that protrudes against and supports the user's back so as to maintain a proper posture and enhance comfort when the chair 3 rocks forward and the chair back 20 stands upright to enable the user to sit erect and close to the work surface (best shown in FIG. 1). The lumbar support 1 is also adapted to undergo a progressive change of shape from the arced, convex configuration (of FIG. 1) to a relatively flattened configuration as the user reclines and the chair rocks backwards so that the back 20 of the chair tilts away from the work surface (best shown in FIG. 2).

The back 20 of the chair 3 within which the progressively curved lumbar support 1 is located stands upwardly from the seat 5. The chair back 20 is surrounded by a protective cover or upholstery (not shown). The back 20 includes a cushion back support 22 that lies inside the back cover and is preferably manufactured from a resilient material (e.g., foam) to provide support for the user's back at all times whether the user leans forward or back in the chair. The cushion back support 22 initially has the aforementioned convex configuration shown in FIG. 1 so as to protrude towards and against the user's back when the chair back 20 stands upright to enable the user to be seated comfortably and close to the work surface. The chair back 20 also includes a rigid (e.g., plywood) backing 24 that lies inside the back cover. When the chair 3 is in use, the backing 24 is spaced from and lies opposite the cushion back support 22.

The chair 3 is shown having a pair of arms 26 and 28 (best shown in FIGS. 3 and 4) located at opposite sides of the seat 5. The arms 26 and 28 are attached to the chair back 20 at opposing brackets 30 and 32 that are affixed to opposite sides of the rigid backing 24 (best shown in FIG. 4). However, the arms 26 and 28 may also be connected to the seat 5 or to each of the back 20 and the seat 5. An arm rest 34 is attached atop each of the pair of arms 26 and 28 upon which the arms of the user may be laid.

Details of the progressively curved lumbar support 1 for the chair 3 are now described while continuing to refer to FIGS. 1-5 of the drawings. According to a preferred embodiment of this invention, the lumbar support 1 includes a posture-maintaining sheet 40 that is attached (e.g., adhesively bonded) to the underside of (i.e., behind) the cushion back support 22 within the chair back 20. The posture-maintaining sheet 40 is manufactured from a relatively stiff but flexible material such as wood, plastic, metal or the like so as to have a spring memory. The sheet 40 is positioned against the cushion back support 22 to maintain the back support in its initially convex configuration (of FIG. 1) when the user sits erect and the chair back 20 stands upright. That is, the posture-maintaining sheet 40 urges the cushion back support 22 to protrude towards and into engagement with the user's lower back. The posture-maintaining sheet 40 is adapted to flex to enable the convex cushion back support 22 to progressively change its shape to the relatively flattened configuration (of FIG. 2) in response to a compressive force generated thereagainst when the user reclines and leans back against the chair back 20.

Figure 2:
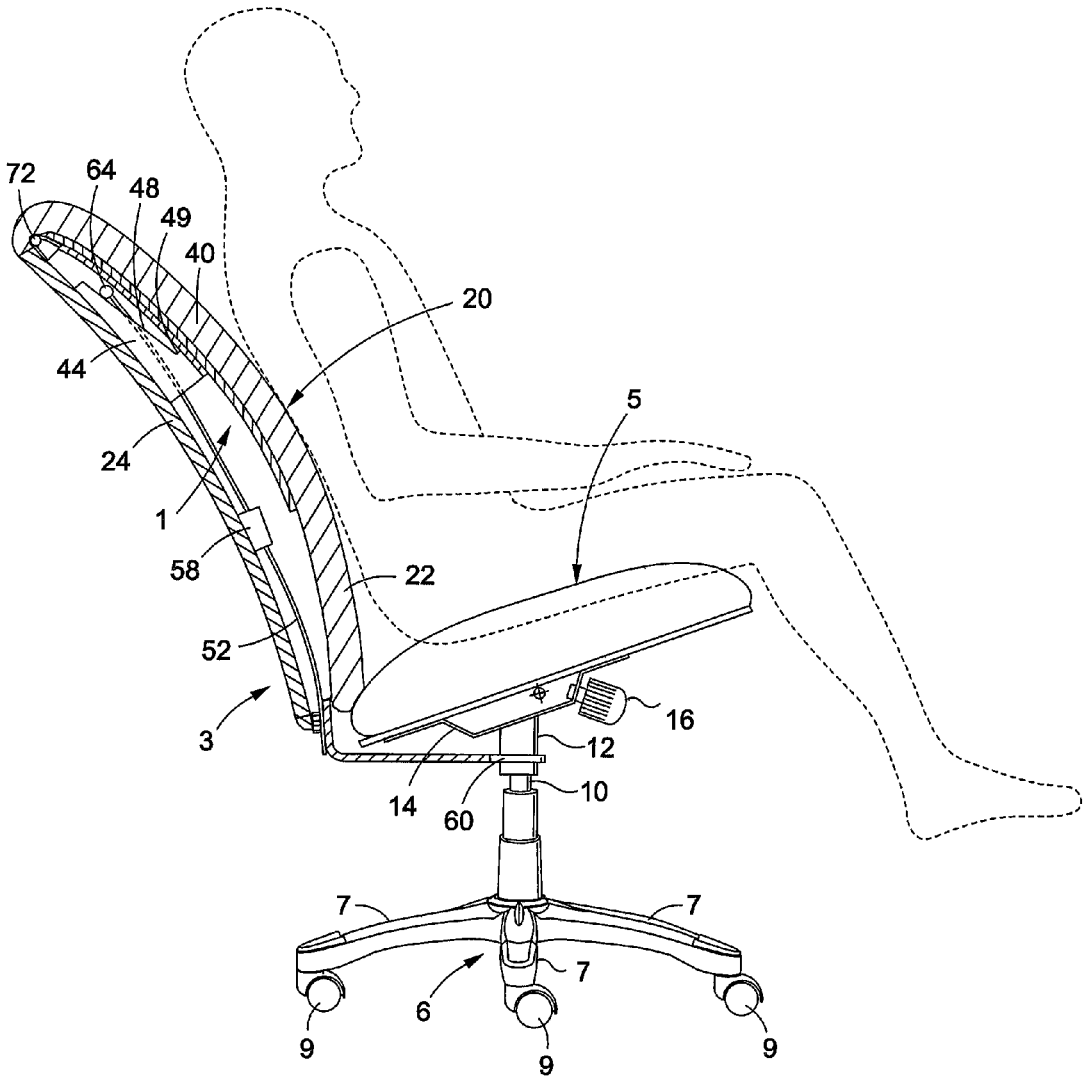
FIG. 2 is a side view of the chair of FIG. 1 with the cushion back support of the progressively curved lumbar support being compressed and flattened when the user leans back in the chair and reclines away from the work surface.
Figure 3:
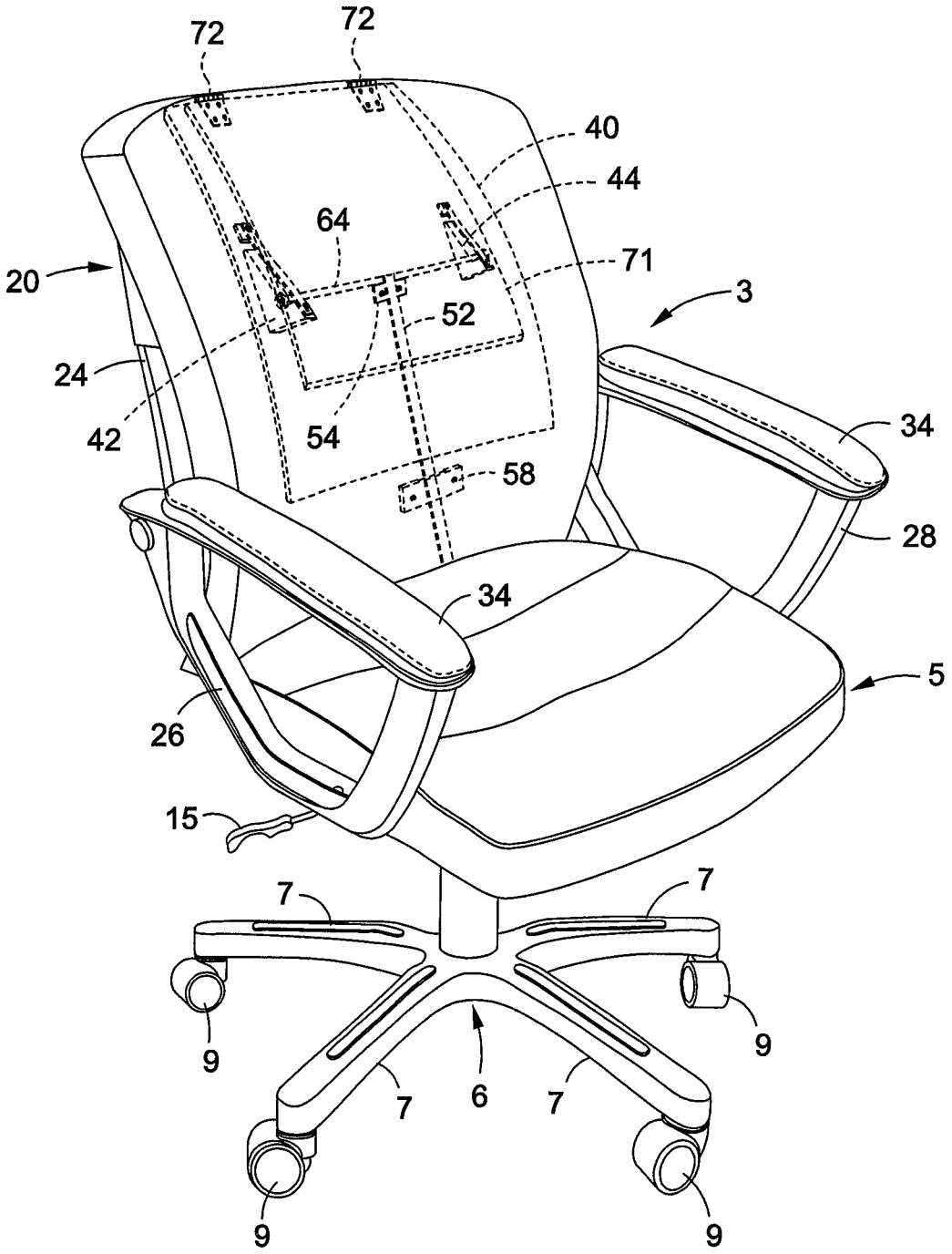
FIG. 3 is a perspective view of the chair of FIGS. 1 and 2 showing the progressively curved lumbar back support inside the chair back between a rigid backing thereof and the cushion back support.
Figures 4, 5:
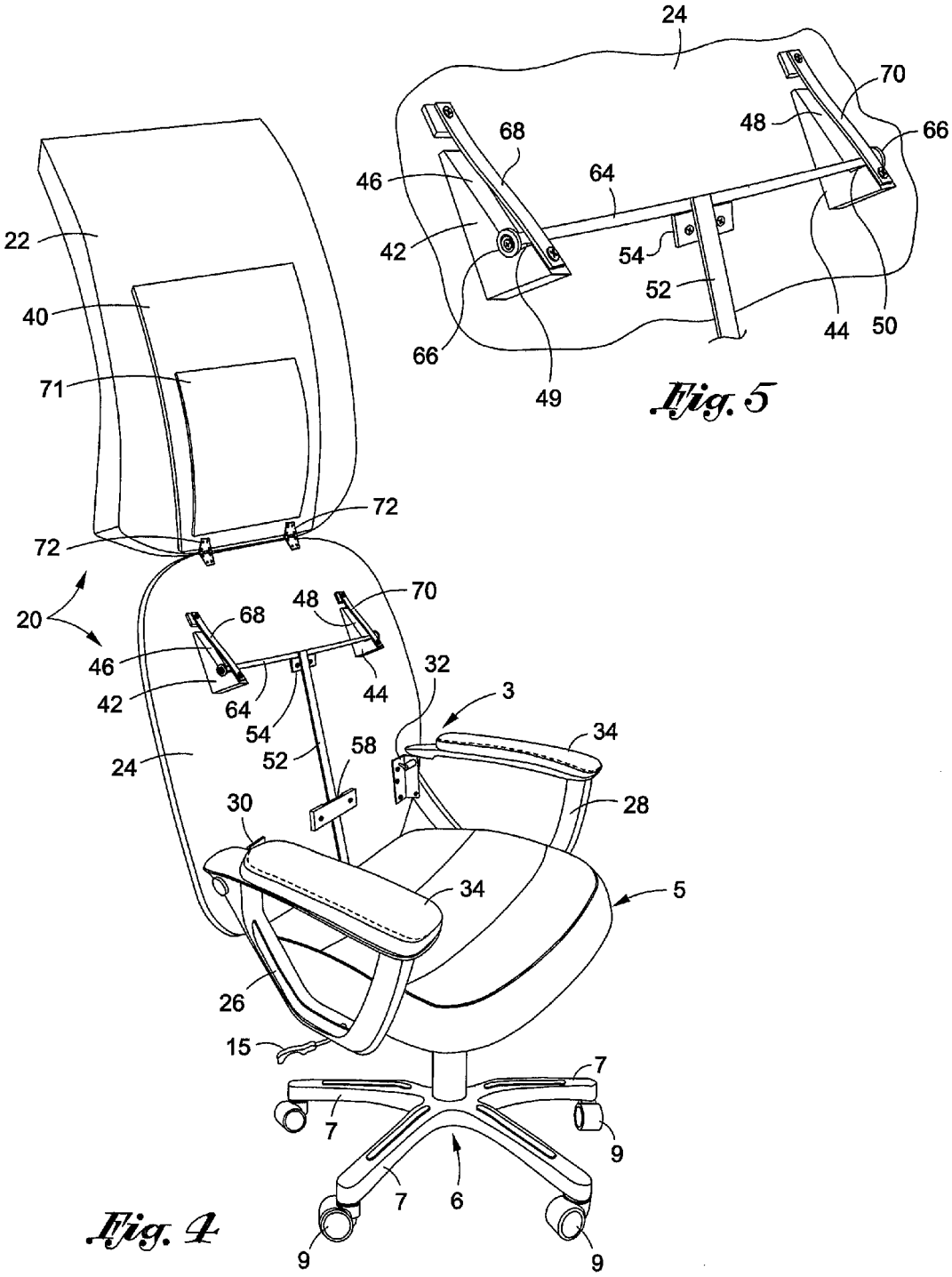
FIG. 4 shows the cushion back support rotated at a set of hinges to an open unfolded condition standing upwardly from the backing to permit access to the progressively curved lumbar support during manufacture and assembly of the chair.
FIG. 5 is an enlarged detail of the progressively curved lumbar support shown in FIG. 4.

The progressively curved lumbar support 1 also includes a pair of inclined guide blocks 42 and 44 that are affixed to opposite sides of the rigid backing 24 of the chair back 20 (best shown in FIGS. 4 and 5). When the cushion back support 22 is rotated to a soon-to-be described folded and closed position as shown in FIGS. 1 and 2 at which to lie opposite and cover the backing 24 of the chair back 20, the inclined guide blocks 42 and 44 project from the backing 22 towards the back support 22. Each of the pair of inclined guide blocks 42 and 44 includes a flat surface 46 and 48 that ramps downwardly towards the top of the backing 24. As is best shown in FIGS. 2 and 5, a stop 49 and 50 is formed at the highest end (relative to the backing 24) of each ramped surface 46 and 48 of each of the pair of inclined guide blocks 42 and 44. The guide blocks 42 and 44 may be manufactured from any wear-resistant material, such as wood, plastic or the like.

A tension strap 52 runs vertically through the back 20 of the chair 3 within the space that separates the cushion back support 22 from the backing 24 when the back support 22 is rotated to its aforementioned folded and closed position. The top of the tension strap 52 is connected to a soon-to-be described tilt pressure-responsive rod 64 by means of an upper bracket 54 such that the top of strap 52 is positioned between the pair of inclined guide blocks 42 and 44. The opposite bottom of the tension strap 52 is connected to a first end of a stationary strap support plate 56. The approximate midpoint of the tension strap 52 is secured to the backing 24 by means of a lower bracket 58 which holds the tension strap 52 close to backing 24.

The first end of the strap support plate 56 which is connected to the vertical tension strap 52 runs below the seat plate 14 at the bottom of the chair seat 5. The opposite end of the strap support plate 56 is attached to the previously-described gas cylinder receiver 12 of the chair 3 which extends downwardly from seat plate 14. By way of example, the opposite end of the strap support plate 56 has a coupling ring 60 shown in FIGS. 1 and 2 which is located in surrounding engagement with the gas cylinder receiver 12 during the manufacture or assembly of the chair 3. The strap support plate 56 is preferably manufactured from a rigid material such as steel or the like.

A tilt pressure-responsive rod 64 is affixed (e.g., welded) across the top of the vertical tension strap 52 so as to extend horizontally through the back 20 of the chair 3. The tilt pressure-responsive rod 64 has a length so that the opposite ends thereof are received against respective ones of the ramped surfaces 46 and 48 of the pair of inclined guide blocks 42 and 44 (best shown in FIG. 5) so as to be adapted to slide therealong in a manner that will soon be explained. A relatively wide end cap 66 is attached to each of the ends of the tilt pressure-responsive rod 64 to prevent the rod from sliding off the guide blocks 42 and 44. In this same regard, rod retention straps 68 and 70 are disposed above the ramped surfaces 46 and 48 of inclined guide blocks 42 and 44 to hold the tilt pressure-responsive rod 64 against the guide blocks 42 and 44. To accomplish the foregoing, a first end of each rod retention strap 68 and 70 is fastened to the backing 24, and the opposite end of each strap 68 and 70 is fastened to highest end of the inclined guide blocks 42 and 44. In this manner, the rod retention straps 68 and 70 will engage the tilt pressure-responsive rod 64 as the rod rides up and down over guide blocks 42 and 44 for an advantage that will soon be described.

An optional friction-reducing sheet 71 is affixed (e.g., adhesively bonded) to the underside of (i.e., behind) the posture-maintaining sheet 40 which is attached to the underside of the cushion back support 22. The sheet 71, which is manufactured from plastic, or the like, has a width that is sized to fit between the pair of inclined guide blocks 42 and 44 when the cushion back support 22 is rotated to its folded and closed position opposite the backing 24 of seat back 20. Thus, the tilt pressure-responsive rod 64 will engage and move along the optional friction-reducing sheet 71 (or the posture-maintaining sheet 40) at the same time that the rod rides up and down over the inclined guide blocks 42 and 44.

As an important feature of this invention, the curved cushion back support 22 of the back 20 of the chair 3 is hingedly connected to the rigid backing 24. In this manner, the cushion back support 22 is rotatable relative to backing 24 between its aforementioned folded and closed position lying opposite the backing 24 (best shown in FIGS. 1-3) so as to cover the tilt pressure-responsive rod 64 and the pair of guide blocks 42 and 44 when the chair 3 is in use at a home or office and an unfolded and open position lying above the backing (best shown in FIG. 4) to expose and permit access to rod 64 and guide blocks 42 and 44 to facilitate the assembly and repair thereof during manufacture of the chair 3.

To enable the cushion back support 22 to rotate between the folded and unfolded positions as just described, and according to one example, the top of each of the cushion back support 22 and the rigid backing 24 are pivotally coupled to one another by means of a pair of conventional hinges 72. The hinges 72 are connected between backing 24 and the opposing flexible sheet 40 carried by back support 22.

The operation of the progressively curved lumbar support 1 and the compression of the cushion back support 22 thereof within the back 20 of the chair 3 for maximizing the comfort and enhancing the posture of one sitting in the chair 3 are now described while continuing to refer to FIGS. 1-5 of the drawings. In FIG. 1, the user is sitting erect in the chair 3, the chair back 20 is tilted forwards and standing upright from the seat 5, and the cushion back support 22 is rotated downwardly to its folded and closed position lying opposite the rigid backing 24. The tension adjustment knob 16 which lies below the seat plate 14 includes a spring (not shown) which automatically biases the chair back 20 to the upstanding position shown in FIG. 1. In this case, the resilient cushion back support 22 of the lumbar support 1 to which the flexible posture-maintaining sheet 40 is bonded is at rest, and little compressive force is applied thereagainst by the user's back.

In its at-rest condition shown in FIG. 1, the resilient cushion back support 22 has an initially arced, convex shape which protrudes forwardly from the chair back 20 towards the user seated in the chair 3 so as to fit comfortably within and provide support for the user's lower back. As previously explained, the posture-maintaining sheet 40 helps to urge the back support 22 towards and into engagement with the user's back. By virtue of the foregoing, the arced, convex cushion back support 22 maintains a proper back posture as the user is working adjacent the work surface. At the same time, the tilt pressure-responsive rod 64 that is affixed to and extends horizontally across the top of the tension strap 52 is held at the highest end of the ramped surfaces 46 and 48 of the pair of inclined guide blocks 42 and 44, and the tension strap 52 stands vertically and at full tension inside the chair back 20.

FIG. 2 shows the chair 3 rocked backwards after the user has reclined and shifted his weight against the chair back 20, so that the chair back 20 tilts away from the work surface. In this case, a compressive force is generated by the user's back against the chair back 20 to cause the resilient cushion back support 22 to be compressed. In its compressed condition as shown in FIG. 2, the shape of the formerly at-rest cushion back support 22 changes from being arced and convex to a shape which is now substantially flattened so as to provide continuous support for the user's lower back. The flexible posture-maintaining sheet 40 attached to the underside of the cushion back support 22 follows the shape of the user's back so as to be pushed back and become slightly bent. That is to say, the compressive force generated by the user's back against back support 22 stresses the flexible posture-maintaining sheet 40, such that the sheet is now flexed and energy is stored.

In FIG. 2, when the user reclines and shifts his weight to generate a compressive force against the cushion back support 22 to cause the chair back 20 to tilt backwards, the vertical tension strap 52 to which the tilt pressure-responsive rod 52 is affixed is correspondingly bent backwards (i.e., in a counterclockwise direction) relative to the stationary strap support plate 56 below the chair seat 5. At the same time that the cushion back support 22 is compressed and the tension strap 52 is bent, the horizontally-extending tilt pressure-responsive rod 64 at the top of the rod 64 is pushed backwards so as to ride down the ramped surfaces 46 and 48 of the pair of inclined guide blocks 42 and 44. It may be appreciated that the tilt pressure-responsive rod 64 is responsive to the compressive force generated by the user's back against the chair back 20 and to the backwards tilt of the chair back so that the movement of rod 64 controls the curvature of the cushion back support 22. Therefore, the initially arced, convex cushion back support 22 will be progressively and continuously flattened as the tilt pressure-responsive rod 64 rides down the inclined guide blocks 42 and 46 and against the opposing friction-reducing sheet 71 at the underside of back support 22.

When the user shifts his weight forwards in the chair 3 and the compressive force being applied to the chair back 20 terminates, the previously-bent tension strap 52 will automatically rotate (in a clockwise direction) back to its original position within the chair back, and the tilt pressure-responsive rod 64 will be simultaneously pulled by the tension strap 52 up the ramped surfaces 46 and 48 of the pair of inclined guide blocks 42 and 44 until the rod 64 is engaged by the stops 49 and 50. At the same time that the tilt pressure-responsive rod 64 rides up the guide blocks 42 and 44, the slightly bent posture-maintaining sheet 40 will release its stored energy and recover, and the previously flattened cushion back support 22 will progressively regain its arced, convex configuration as shown in FIG. 1 to once again protrude towards and support the user's lower back.

As was previously described, should an adjustment or repair of the lumbar support be required during manufacture of the chair 3, an uplifting rotational force is applied to the cushion back support 22. In this case, the back support 22 will rotate upwardly at the hinges 72 in a counter-clockwise direction relative to the backing 24 from the folded closed position of FIG. 1 lying opposite backing 24 to the unfolded open position of FIG. 4 standing upwardly from the backing 24. Likewise, the hinges 72 permit the cushion back support 22 to pivot and shift relative to the rigid backing 24 when the back support is in its folded closed position and the tilt pressure-responsive rod 64 is being pushed and pulled up and down over the inclined guide blocks 42 and 44 in response to the chair back 20 tilting back and forth.

Figures 6, 7:
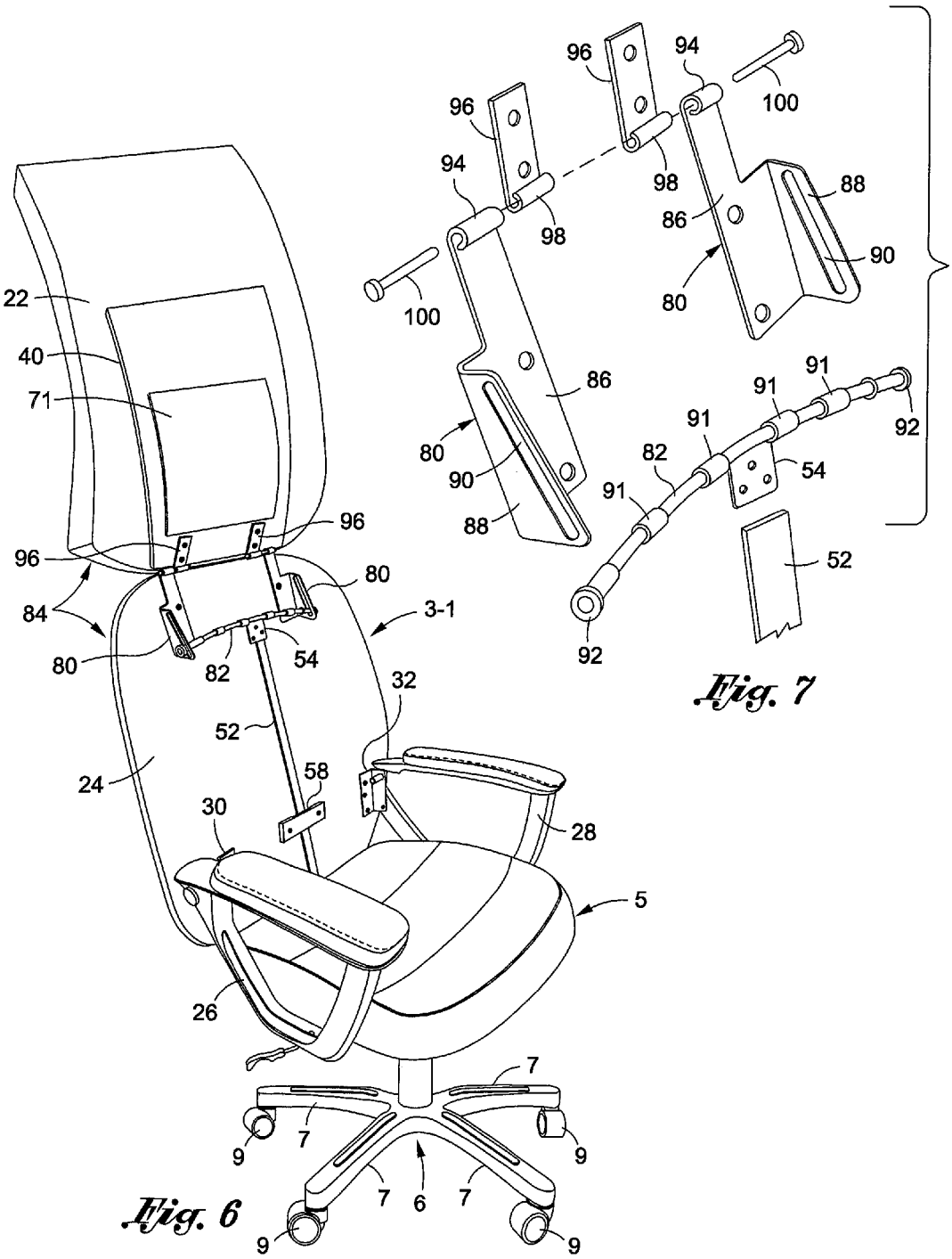
FIGS. 6 and 7 shows the cushion back support of the progressively curved lumbar support rotated to the open unfolded condition at a different set of hinges by which the cushion back support is pivotally coupled to the backing inside the chair back.

Turning now to FIGS. 6 and 7 of the drawings, the inclined guide blocks 42 and 44 and the hinges 72 of the chair 3 described while referring to FIGS. 1-5 are replaced by a pair of combination one-piece inclined rod guides and couplers 80. The one-piece combinations 80 facilitate the movement of a horizontally-extending tilt pressure-responsive rod 82 through the chair back 84 of a chair 3-1 in response to the chair back tilting backwards and forwards and a compressive force being applied to the cushion back support 22 thereof.

In particular, each of the combinations 80 includes a base plate 86 affixed to the top of the rigid backing 24 of the chair back 84 and a guide plate 88 which bends upwardly from the base plate 86. The base plate 86 has a sloping or ramped slot 90 formed therein. In the assembled chair configuration of FIG. 6, opposite ends of the tilt pressure responsive rod 82 are adapted to slide up and down the sloping slots 90 as the tension strap 52 to which the tilt pressure-responsive rod 82 is connected rotates to correspondingly push or pull the rod in the manner previously described when referring to FIGS. 1-5. The sloping slots 90 have a generally oval shape to surround and thereby retain the ends of the tilt pressure-responsive rod 82 therewithin as the rod slides therethrough. The tilt pressure-responsive rod 82 is surrounded by a set of rollers 91 to facilitate the movement of rod 82 along the optional friction-reducing sheet 71 or the posture-maintaining sheet 40. The tilt pressure-responsive rod 82 also has removable end caps 92 to permit the opposite ends thereof to be located within the sloping slots 90 formed in the guide plates 88 of the pair of combinations 80. The end caps 92 may be mated to the rod 82 so as to be received by and roll along slots 90.

The base plate 86 of each combination inclined rod guide and coupler 80 has a hollow cylindrical sleeve 94 formed at one end thereof. A pair of bracket plates 96 are affixed to the top of the cushion back support 22. Each bracket plate 96 has a hollow cylindrical sleeve 98 at one end thereof. The respective hollow sleeves 94 and 98 of the base plates 86 and the bracket plates 96 are axially aligned with one another, and coupling pins 100 are inserted therethrough. The coupling pins 100 pivotally connect the cushion back support 22 to the rigid backing 24 of the chair back 84 so that the back support 22 can be rotated between its aforementioned folded closed and unfolded open positions as has been previously disclosed.

The invention claimed is:

1. A chair comprising:

a seat to support the weight of a user;

a stationary base to hold the seat above the ground; and a back having first and opposite sides to support the back of the user, said back being coupled to said stationary base and adapted to tilt forwards and backwards relative to said stationary base, and including:

a backing located at the first side of said back and a cushion back support having a curved configuration and located at the opposite side of said back to engage and support the user's lower back when the user sits erect in the chair and said back tilts forwards, said cushion back support also having an outside surface at which to engage the user's lower back and an inside surface being spaced from and lying opposite said backing, a tilt pressure-responsive rod located within the back of said chair between said backing and the inside surface of said cushion back support, and a flexible tension strap connected between said tilt pressure-responsive rod and said stationary base, said flexible tension strap bending back and forth to cause said tilt pressure-responsive rod to correspondingly move in first and opposite directions relative to said stationary base and ride over and against the inside surface of said cushion back support in response to the back of said chair tilting forwards and backwards to cause said cushion back support to progressively change its shape between said curved configuration and a relatively flattened configuration depending upon the location of said tilt pressure-responsive rod against the inside surface of said cushion back support.

2. The chair recited in claim 1, wherein the back of said chair also includes at least one inclined rod guide, said tilt pressure-responsive rod moving in said first and opposite directions relative to said stationary base and riding up and down said inclined rod guide and over and against the inside surface of said cushion back in response to said back tilting forwards and backwards.

3. The chair recited in claim 2, wherein said at least one inclined rod guide has a ramped surface and wherein said tilt pressure-responsive rod extends horizontally between the first and opposite sides of the back of said chair, said tilt pressure-responsive rod riding down said ramped surface when said back tilts backwards and riding up said ramped surface when the back tilts forwards.

4. The chair recited in claim 3, wherein the ramped surface of said at least one inclined rod guide includes a stop to intercept and block the movement of said tilt pressure-responsive rod when the back of said chair tilts forwards and said rod rides up said ramped surface.

5. The chair recited in claim 3, wherein said chair back also includes a rod retention strap located above the ramped surface of said at least one inclined rod guide to retain said tilt pressure-responsive rod against said rod guide as said rod rides up and down said ramped surface when said chair back tilts forwards and backwards.

6. The chair recited in claim 3, wherein said flexible tension strap stands upwardly from the stationary base of said chair so as to lie within the back of said chair between the inside surface of said cushion back support and said backing, said flexible tension strap bending away from said stationary base when said back tilts backwards for causing said tilt pressure-responsive rod to ride down the ramped surface of said at least one inclined rod guide.

7. The chair recited in claim 6, wherein said stationary base includes a gas cylinder receiver located below the seat of said chair and a gas cylinder communicating with said gas cylinder receiver in order to adjust the height of said seat above the ground, said tension strap being coupled to the stationary base of said chair at the gas cylinder receiver thereof.

8. The chair recited in claim 2, wherein said cushion back support is rotatable relative to said backing between a first position lying opposite said backing and covering each of said inclined rod guide and said tilt pressure-responsive rod and a second position standing upwardly from and lying above said backing to uncover and permit access to each of said rod guide and said tilt pressure-responsive rod.

9. The chair recited in claim 8, wherein said cushion back support is hingedly coupled to said backing to enable said cushion back support to rotate relative to said backing between said first and second positions.

10. The chair recited in claim 1, wherein the cushion back support of the back of said chair is manufactured from a resilient material that is responsive to a compressive force applied thereto, said cushion back support having said curved configuration when the user sits erect in the chair and said back tilts forward, and the shape of said cushion back support progressively changing to said relatively flattened configuration when the user leans back and applies a compressive force against said back to simultaneously cause said back to tilt backwards, said cushion back support to be compressed, and said tilt pressure-responsive rod to ride over and against the inside surface of said cushion back support.

11. The chair recited in claim 1, wherein the back of said chair also includes a flexible sheet having a spring memory and being positioned against the inside surface of said cushion back support to push said cushion back support having said curved configuration into engagement with the user's lower back, said flexible sheet being bent and storing energy in response to a compressive force applied by the user to said back to simultaneously cause said back to tilt backwards and said cushion back support to progressively change its shape from said curved configuration to said relatively flattened configuration, said flexible sheet relaxing and releasing its stored energy to cause the cushion back support to change its shape from said relatively flattened configuration to said curved configuration when the compressive force applied to said back is terminated and said back tilts forwards.

12. A chair comprising:

a seat to support the weight of a user;

a stationary base to hold the seat above the ground; and a back having first and opposite sides to support the back of the user, said back being coupled to said stationary base and adapted to tilt forwards and backwards relative to said stationary base and including:

a cushion back support located at the first side of said back and having a curved configuration to engage and support the user's lower back when the user sits erect in the chair and the back of said chair tilts forwards, and a backing lying opposite said cushion back support at the opposite side of said back such that there is a space therebetween, a ramped surface connected to said backing at the opposite side of said back and projecting therefrom towards said cushion back support at the first side of said back, a tilt pressure-responsive rod located within the space between said backing and said cushion back support and being received by said ramped surface, said tilt pressure-responsive rod riding up and down said ramped surface and over and against said cushion back support in response to the back of said chair tilting forwards and backwards to cause said cushion back support to progressively change its shape between said curved configuration and a relatively flattened configuration depending upon the location of said tilt pressure-responsive rod on said ramped surface, and a flexible tension strap having first and opposite ends connected at the first end thereof to said tilt pressure-responsive rod and at the opposite end to the stationary base of said chair and extending through the space between said backing and said cushion back support, the first end of said tension strap bending relative to said stationary base and moving backwards towards said backing when the back of said chair tilts backwards for causing said tilt pressure-responsive rod to ride down said ramped surface and said cushion back support to change its shape from said curved configuration to said relatively flattened configuration.

13. The chair recited in claim 12, wherein the back of said chair also includes a flexible sheet having a spring memory and being positioned against said cushion back support so as to lie opposite said backing to push said cushion back support having said curved configuration into engagement with the user's lower back, said flexible sheet being bent and storing energy in response to a compressive force applied by the user to said back to simultaneously cause said back to tilt backwards, said tilt pressure-responsive rod to ride down said ramped surface, and said cushion back support to progressively change its shape from said curved configuration to said relatively flattened configuration, said flexible sheet relaxing and releasing its stored energy to cause said tilt pressure-responsive rod to ride up said ramped surface and the cushion back support to change its shape from said relatively flattened configuration to said curved configuration when the compressive force applied to said back is terminated and said back tilts forwards.

14. The chair recited in claim 12, wherein said cushion back support is rotatable relative to said backing between a first position lying opposite said backing and covering each of said ramped surface and said tilt pressure-responsive rod and a second position standing upwardly from and lying above said backing to uncover and permit access to each of said ramped surface and said tilt pressure-responsive rod.

15. The chair recited in claim 14, wherein said cushion back support is hingedly coupled to said backing to enable said cushion back support to rotate relative to said backing between said first and second positions.

* * * * *